US006758220B2

(12) United States Patent
Willis

(10) Patent No.: US 6,758,220 B2
(45) Date of Patent: Jul. 6, 2004

(54) E-Z NAIL LIFTER

(76) Inventor: Darlene Willis, 797 Candace Cove, Memphis, TN (US) 38116

( * ) Notice: Subject to any disclaimer, the term of this patent is extended or adjusted under 35 U.S.C. 154(b) by 0 days.

(21) Appl. No.: 10/060,453

(22) Filed: Jan. 30, 2002

(65) Prior Publication Data

US 2002/0148479 A1 Oct. 17, 2002

Related U.S. Application Data

(60) Provisional application No. 60/123,249, filed on Mar. 8, 1999.

(51) Int. Cl.[7] ..... A45D 29/18

(52) U.S. Cl. ..... 132/200; 132/73.5

(58) Field of Search ..... 132/73, 73.5, 75.6, 132/76.4, 76.5, 200; 15/236.01, 236.02, 236.08, 245.1; 30/26

(56) References Cited

U.S. PATENT DOCUMENTS

| | | | | | |
|---|---|---|---|---|---|
| 875,681 | A | * | 1/1908 | Asbury | 132/75.6 |
| 1,370,461 | A | * | 3/1921 | Lobl | 132/75.6 |
| D116,216 | S | * | 8/1939 | Brekke | 132/75.6 |
| D141,265 | S | * | 5/1945 | Miller | 132/75.6 |
| D154,227 | S | * | 6/1949 | Alvizua | 132/75.6 |
| 2,516,423 | A | * | 7/1950 | Roe | 132/75.6 |
| 4,248,660 | A | * | 2/1981 | Johnson | 156/579 |
| 4,384,587 | A | * | 5/1983 | Milgrom | 600/570 |
| 4,930,529 | A | * | 6/1990 | Whitney | 132/73 |
| 5,095,573 | A | * | 3/1992 | Henke et al. | 15/105 |
| 5,163,455 | A | | 11/1992 | Pointe | 132/76.4 |
| 5,388,597 | A | | 2/1995 | Smith | 132/73.5 |
| 5,609,166 | A | | 3/1997 | Walker | 132/73 |
| 5,921,250 | A | | 7/1999 | Rhea | 132/74.5 |
| 5,996,590 | A | | 12/1999 | Steege | 132/76.4 |
| 6,035,858 | A | | 3/2000 | Park | 132/73 |
| 6,102,048 | A | | 8/2000 | Baker | 132/76.4 |
| 6,289,901 | B1 | * | 9/2001 | Singer et al. | 132/76.4 |

* cited by examiner

*Primary Examiner*—Todd E. Manahan

(57) ABSTRACT

An artificial nail remover device that consists of a thin, squared head at one end, and is buffered at the opposite end. The length of the device has grooved gripping apertures along the elongated body. The body is made of a flexible plastic that allows for maneuvering without fracturing after repeated use when removing artificial nails and nail tips. The artificial nail remover device eliminates the need to soak the natural nails in any solution that could cause damage to the natural nail. The handle is versatile, for use with either the right or left hand with ease. The artificial nail remover device interfits between the artificial nail and the natural nail allowing one to remove the artificial nail with ease.

1 Claim, 2 Drawing Sheets

E-Z NAIL LIFTER

CROSS REFERENCE TO RELATED APPLICATIONS

This application claims the benefit of Provisional Patent Application serial No. 60/123,249 filed Mar. 8, 1999.

BACKGROUND OF THE INVENTION

1. Field of the invention

The present invention relates to an artificial nail remover device. The present invention is integrally molded for removing artificial fingernails and nail tips from the natural nail bed.

2. Description of Related Art

Artificial fingernails and nail tips are usually applied to the natural nail by a licensed nail technician in a nail salon. The technician is generally trained in the use of both nail adhesive and the use of a acetone or acid base solution that is used to remove the false nail from the nail base.

Ordinarily artificial nails or nail tips are removed in a salon by a nail technician, who allows the nails to soak in a solution for a specific period of time. This allows time for the nail adhesive to become pliable enough to remove the false nail from the nail bed. The acetone solution has properties that tend to dry moisture out of the natural nail, causing the natural nail to become more fragile.

Grocery stores and supermarkets commonly supply consumers with products that remove fingernail polish. However acetone solutions for removing nail adhesive must be purchased at specialty stores that specialize in this type of product. These specialty stores generally supply the trained professional with the tools of their trade. They are trained in the proper use and containment of the acetone solution.

Though all of the prior art nail removers serve the same goal, the removal of the artificial nail, they are designed in various configurations with a variety of different attachments which are used to assist the technician in the removal of the artificial nail.

However they do not provide this unique way to remove the nail. The present invention is fashioned in such a way that it is peculiarly adaptable for removing artificial nails and nail tips without the use of any acid based solution. This invention does not require any level of technical skill. It's unique features allow for both skilled and unskilled users to be able to perform the same task with relative simplicity.

A search in the United States Patent Office has revealed the following patents:

| U.S. Pat. No. | INVENTOR | ISSUE DATE |
|---|---|---|
| 5163455 | Robert Pointe | Nov. 17, 1992 |
| 5388597 | Clifford Smith | Feb. 14, 1995 |
| 5609166 | Alvin Walker | Mar. 11, 1997 |
| 5921250 | Cord Rhea | Ju1. 13, 1999 |
| 5996590 | Melissa Steege | Dec. 07, 1999 |
| 6035858 | Chung Hoon Park | Mar. 14, 2000 |
| 6102048 | Oleda Baker | Aug. 15, 2000 |

While the foregoing patents describe various artificial nail remover devices none have the unique combination of features as provided in the instant invention.

The present invention eliminates the need to soak the artificial nails prior to removal, which means it is less expensive to manufacture and use.

U.S. Pat. No. 5,699,166 to Walker(1997) is a device adapted to remove artificial fingernails. It is comprised of a rectangular container with an inner bristle housing. This apparatus still requires the user to soak the nail in a solution before the removal of the nail.

U.S. Pat. No. 5,163,455 to Pointe (1992) is a manicure file for acrylic nails, it includes an elongated flexible stick with emery material. The purpose of this invention is to smooth the acrylic nail without damaging the cuticle or skin surrounding the nail. Although the file has a buffing feature that is suitable for the surface of acrylic nails it is not suitable for the removal of such nails.

U.S. Pat. No. 5,388,597 to Smith (1995) is an artificial fingernail remover and brush cleaner. The housing is used to hold act a solution to soak the nails. The nails are soaked until sufficiently pliable for removal.

U.S. Pat. No. 5,921,250 to Rhea (1999) is an artificial nail remover device that uses hot water in a basin which agitates the solution for removal of the false nails.

U.S. Pat. No. 5,996,590 to Steege (1999) is a conical (cone shaped) nail file designed to interfit underneath an acrylic nail and reach and file the area of the acrylic nail adjacent to the free end of the natural fingernail and the nail bed. Though designed to fit under-neath the acrylic nail, the conical surface is not capable of removing the artificial nail from the nail bed.

U.S. Pat. No. 6,102,046 to Baker (2000) is an instrument and method for manicuring the underside of a natural, artificial and acrylic fingernail. It is designed to manicure the nail but does not have the capability of removing the false nail from the nail bed.

U.S. Pat. No. 6,035,858 to Park (2000) is a nail device with a circuit system, which utilizes an ultrasonic wave to remove artificial nails for the nail bed. It massages the nails and hands of the user. However it includes a case that is used to receive a solution, when in operation the generator generates an ultrasonic wave for producing oscillation in the solution. This device requires the user to place the fingernails into a solution, and for the nail to remain in that solution for a determined amount of time.

None of these patents describe the present invention. The prior art described above requires a soaking solution in order to remove old acrylic nails and nail tips, or their design does not permit for removal of the false nails. While the other patents are capable of removing artificial or acrylic nails, the methods used suffer a number of disadvantages:

(a) Their manufacture would require housing for the acetone or other solution. The presence of acetone or some type of solution is required in order to make the apparatus useable for it's intended purpose. The additional housing would add to the cost of production.

(b) Prolonged exposure to acetone, which is a strong chemical substance, can cause damage to the natural nail. The time often required for soaking, sufficient to make the adhesive pliable is about 30 minutes.

(c) After the nail is removed a certain amount of filing would be required to remove the remaining nail adhesive. Excessive filing, especially after exposure to a chemical solution, can result in the natural nail becoming weak and less healthy.

(d) The use of any solution would add to the cost to the consumer, who is unskilled in the use of such products. The end results could be costly, since consumers are less apt to read and follow instructions.

SUMMARY

The present invention is a unique artificial nail remover device. It is the principal object of the present invention to provide a device that would allow the user to remove an artificial nail without the need to soak the nail in a solution, and without damage to the natural nail. Thereby removing the nail in a minimum amount of time and expense. The embodiment of the invention is the tip, which is positioned to provide the maximum leverage for removing the false nail without engaging the surrounding cuticle. The present invention has a plurality of longitudinal ribbing along the sides to allow for ease and security in handling while maneuvering the tip of the flat plastic head between the artificial nail and the natural nail. It removes old acrylic nails and nail tips quickly, easily and safely, while saving the nail bed. The user is not required to pre-soak the nail, this allows the false nail to be removed in half the time, and requires no additional skill or training.

DETAILED DESCRIPTION OF THE INVENTION

Figure 1A:
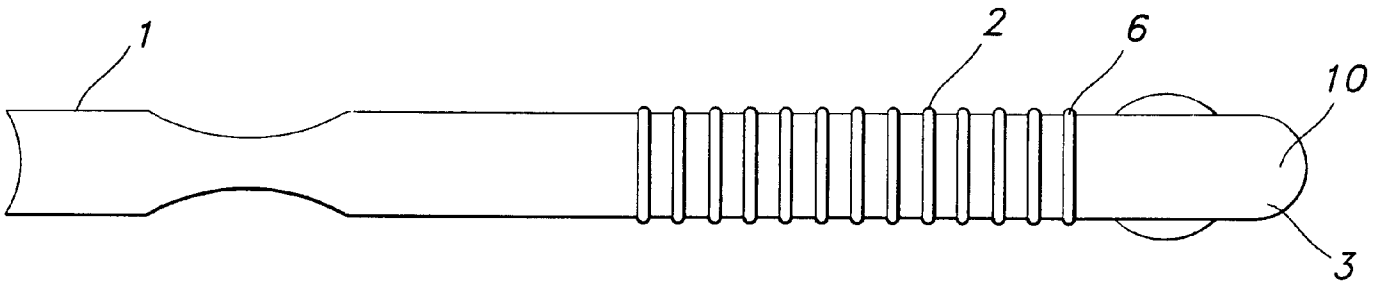
FIG. 1A is a perspective representational top view of the artificial nail remover device.
Figure 1B:
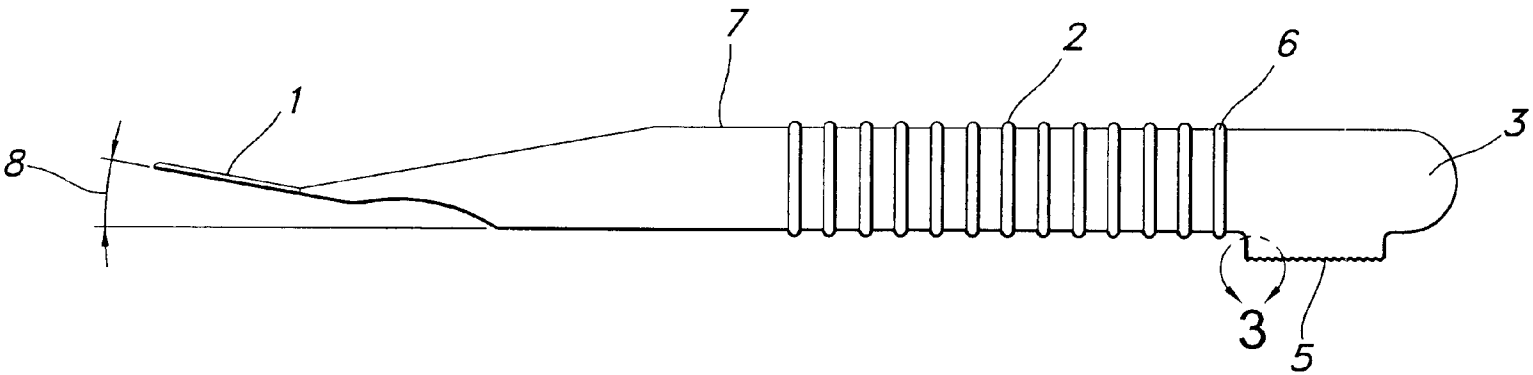
FIG. 1B is a side view of the artificial nail remover device.
Figure 3:
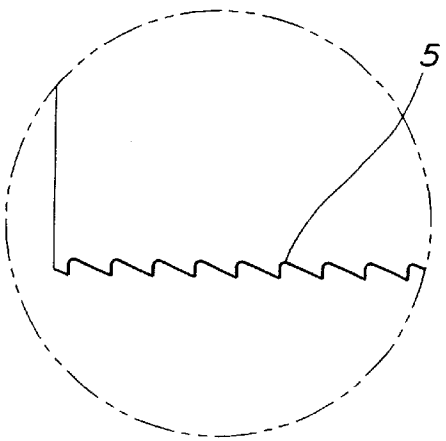
FIG. 3 is an enlarged view of FIG. 1B at 5.
Figure 2B:
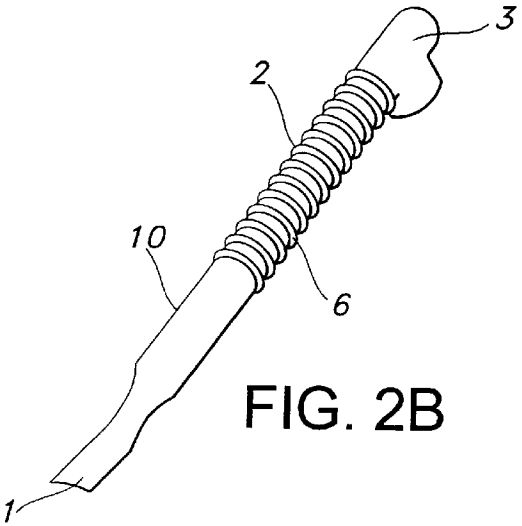
FIG. 2B is a side elevation view of the artificial nail remover device.
Figure 2A:
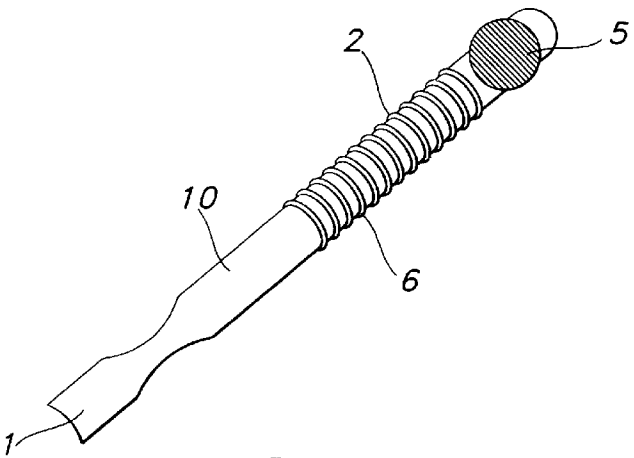
FIG. 2A is a bottom elevation view of the artificial nail remover device.

A preferred embodiment of the present invention is illustrated in FIG. 1A (top view), FIG. 1B (side view) and FIG. 2A (bottom view). The unique artificial nail remover device 10 that has a head formed of a unique construction, which is of relatively thin plastic. The curvature of the head is shaped into a square to allow the user to maneuver the artificial nail remover device 10 between the artificial nail and the natural nail bed without causing damage to the surrounding area. The artificial nail remover device 10 is made of an elongated plastic body 2 having a top surface 7 and a bottom surface 8. The elongated plastic body 2 has at one end, a very thin, flat plastic head 1. In the center, the elongated plastic body 2 has a plurality of longitudinal ribbing 6 and plastic handle 3. Although the flat plastic head 1 is thin, it is made up of a flexible, hard plastic which can be repeatedly used without fracturing. Because the flat plastic head 1 is durable the user can position the artificial nail remover device 10 between the artificial nail and the natural nail bed, and then slide the artificial nail remover device 10 under and across the artificial nail and lift it off. The squared tip of the flat plastic head 1 also helps to avoid snagging and injury to the area around the natural nail during removal of the artificial nail. As shown in FIG. 1B, the flat plastic head 1 is at an angle of 10° above the bottom surface 8 of the elongated plastic body 2.

Along the bottom surface 8 of the artificial nail remover device 10 is a buffer surface 5 used to buff off the rough edges of the nail before polishing the natural nails, or preparing the natural nails for new false nails or nail tips.

A plurality of longitudinal ribbing 6 along the center of the nail lifter 10 allow for a more secure grip while removing the nail. This plurality of longitudinal ribbing 6 also allows the artificial nail remover device 10 to be used by either a right or left handed person with the same amount of ease.

What I claim as my invention is:

1. The method of removing artificial nails comprising:

the plastic body having of a plurality of longitudinal ribbing along the center of said plastic body; and the plastic body having a flat plastic head at an angle of 10° above the bottom surface of said plastic body, placing the artificial nail remover between the artificial nail and the natural nail bed;

sliding said artificial nail remover device under and across the artificial nail; and lifting artificial nail off.

* * * * *